US005911591A

United States Patent [19]

Bowcutt

[11] Patent Number: 5,911,591

[45] Date of Patent: Jun. 15, 1999

[54] ELECTRICAL CABLE CONNECTION DEVICE AND METHOD

[75] Inventor: Vaughn Bowcutt, Salt Lake City, Utah

[73] Assignee: Kyden Machine, Inc., Salt Lake City, Utah

[21] Appl. No.: 08/936,874

[22] Filed: Sep. 25, 1997

[51] Int. Cl.[6] ..... H01R 13/62

[52] U.S. Cl. ..... 439/369; 439/491

[58] Field of Search ..... 439/367, 369, 439/370, 488, 491

[56] References Cited

U.S. PATENT DOCUMENTS

| | | | |
|---|---|---|---|
| 4,884,979 | 12/1989 | Budner | 439/369 |
| 5,551,888 | 9/1996 | Rhodes, Sr. | 439/369 |
| 5,685,732 | 11/1997 | Lane | 439/369 |
| 5,713,753 | 2/1998 | Bayer et al. | 439/369 |
| 5,782,649 | 7/1998 | Aiken | 439/369 |

*Primary Examiner*—Khiem Nguyen
*Attorney, Agent, or Firm*—Clayton Howarth & Cannon, P.C.

[57] ABSTRACT

An electric cable connector device for use with pothead connectors has a base member with a wide lower portion and an elevated portion for maintaining an electrical connection formed by two electrical cables above the ground while permitting the device to move on the ground and thus prevent electrical short, dirt contamination, and inadvertent damage. The base member may also have a first and second leg portions configured for straddling a berm such that the device moves along a berm without entering a roadway. Apertures are formed in the base member for forks of a forklift or for a chain or cable such that the device and connection may be moved. The connectors and/or cables are secured to the base member by clamps. Slide mechanisms may be disposed between the clamps and the base member such that the connectors may be slid apart for inspection and repair while remaining secured to the base member. Cable guides are coupled to the base member and have a channel formed between two curved surfaces to prevent the cable from kinking. The base member may be painted a bright or flourescent color, have reflective material attached, and/or have a flag attached to increase visibility and prevent inadvertent damage.

18 Claims, 2 Drawing Sheets

ELECTRICAL CABLE CONNECTION DEVICE AND METHOD

BACKGROUND OF THE INVENTION

1. Field of the Invention

The present invention relates to a device and method, particularly suitable for use in mining and industrial applications, for maintaining a connection between two electrical cables at a height above the ground to prevent electrical shorts, dirt contamination and damage. More particularly, the present invention relates to an electrical cable connector device having ends of electrical cables secured to an elevated portion of a base member which is movable on the ground, thus maintaining the connection above the ground while allowing the cable and connector device to be moved as required by the electrical application.

2. Prior Art

Electrical power is often required in remote and/or temporary locations, such as construction and industrial sites, or for mobile equipment, such as mine shovels. Such construction or industrial sites are typically in a state of flux and ill suited for permanent electrical structures, such as power poles. Likewise, such mobile equipment may move frequently or be temporarily located making permanent electrical facilities infeasible. In such situations, electrical cables are often strung together to supply the required electrical power from a source to the site or equipment application, much like household extension cords. Such electrical cables are similar in structure to extension cords, but on a larger, industrial scale and carry much higher voltages. The cable can be a few inches in diameter and the connectors, called potheads, can be several inches in diameter and weigh several pounds. Such electrical cables may be temporarily laid or semi-permanently installed, but are often laid on the ground or strung along roads.

The position of the cables on the ground and their location at industrial or mining sites poses several problems. The connections, or potheads, may come in contact with moisture, such as puddles, causing electrical shorts and the danger of electrocution. In addition, dirt contaminates the potheads, hindering effective electrical connection. Furthermore, heavy equipment may inadvertently drive over the connections, damaging the pot heads, interrupting the electrical supply, and causing electrocution. Moreover, in mobile equipment applications the cable may be dragged behind the equipment, exerting a force on the connection tending to separate the connectors or pull the cable from the connector. Such movement of the equipment also causes the connectors and cable to become displaced onto roadways where damage by heavy equipment is more likely.

In an attempt to keep the connection out of ground water, the connectors have been placed on sawhorses or other makeshift platforms. Although this configuration keeps the connectors out of the dirt and mud temporarily, cable movement causes the connectors to fall off the sawhorses. In addition, this does little to prevent heavy equipment from inadvertently driving over the connectors.

Various attempts directed at maintaining the electrical connection between household extension cords are disclosed in U.S. Pat. Nos. 2,434,521; 3,029,408; 3,484,736; 4,690,476; 5,104,335; 5,179,044; 5,217,387; and 5,474,465. Many of these patents are directed only at preventing the extension cords from unplugging. Others include water resistance housings or water tight seals. U.S. Pat. No. 5,551,888 issued Sep. 3, 1996 to Rhodes, Sr. discloses a protector for extension cord plugs. The extension cord plugs are disposed in an enclosure or container with a hinged lid and openings in either side for the cords to pass through. The plugs are prevented from decoupling by as in a stationary position. The housing is secured in a stationary configuration by driving a pair of stakes, formed integrally with the housing, into the ground. The housing may be raised off the ground by only partially driving in the stakes. One problem with this configuration is that it is fixed to the ground by the stakes, thus preventing the housing from moving with the cord or the cord from moving with the application. If the cord was moved by sufficient force, the housing, stakes, and/or cord would be damaged.

Therefore, it would be advantageous to develop a connector device to prevent short circuits or electrocution by maintaining the connection above the ground. It would also be advantageous to develop a connector device capable of moving with the application, such as heavy equipment. It would also be advantageous to develop a connector device to prevent inadvertent damage, such as by heavy equipment. It would also be advantageous to develop a connector device to prevent displacement of the connection into a roadway. It would also be advantageous to develop a connector device capable of securing the connectors together and to the device. It would also be advantageous to develop a connector device capable of parting the connectors for inspection, cable continuity checks, and connector maintenance. In addition, it would be advantageous to develop a connector device to prevent kinking of the cable.

OBJECTS AND SUMMARY OF THE INVENTION

It is an object of the present invention to provide a connector device for preventing short circuits, electrocution, and moisture and dirt contamination, cable continuity checks, and connector maintenance.

It is another object of the present invention to provide a connector device for maintaining a connection above the ground.

It is yet another object of the present invention to provide a connector device that can move with the application such as heavy equipment.

It is yet another object of the present invention to provide a connector device with a sled base for dragging on the ground.

It is yet another object of the present invention to provide a connector device with apertures for facilitating being lifted by a forklift or coupled to chains.

It is yet another object of the present invention to provide a connector device for preventing displacement into a roadway.

It is yet another object of the present invention to provide a connector device that straddles a berm, such as along a road.

It is yet another object of the present invention to provide a connector device for securing the connector together and to the device.

It is yet another object of the present invention to provide a connector device with clamps for clamping the connectors and the cables.

It is yet another object of the present invention to provide a connector device for separating the connectors while still securing the connectors to the device.

It is yet another object of the present invention to provide a connector device with clamps mounted on slides to separate the connectors.

It is yet another object of the present invention to provide a connector device for preventing the cable from kinking.

It is yet another object of the present invention to provide a connector device with a cable guide.

It is yet another object of the present invention to provide a connector device that is highly visible to prevent damage thereto.

It is a further object of the present invention to provide a connector device with bright and/or flourescent color, reflective material, and/or a flag.

These and other objects and advantages of the present invention are realized in an electric cable connector device having a base member moveable on the ground with an elevated portion for maintaining a connection between two cables above the ground while permitting the connection to be moved; apertures formed in the base member for being moved by a forklift or chains; first and second leg portions configured to straddle a berm; clamps for securing pothead connectors and cables to the base member; slide mechanisms disposed between the clamps and base member for permitting the pothead connectors to be slid apart; a cable guide to prevent kinking; and highly visible colors, reflective material, and a flag for increasing the visibility of the connector device.

The base member has a wide lower portion to prevent the connector device from being overturned. A sled is formed on the lower portion for sliding on the ground as the cables are moved or pulled. The base preferably has first and second leg portions configured for straddling a berm so that the connection device may move or be dragged alongside a road without entering the road. The base member also has an elevated portion for maintaining the connection above the ground, thus preventing dirt and moisture contamination and preventing electrical shorts.

Forklift apertures and chain apertures are preferably formed in the base member and sized appropriately to permit the base member and/or connection to be moved by the forks of a forklift or by a chain or cable.

Clamps are disposed on the elevated portion of the base member and secure the pothead connectors and/or the cables to the base member. The clamps prevent a force created by the moving cables from separating the connection. In addition, the clamps cause the base member to move along with the cables. The clamps may be disposed on slide mechanisms so that the potheads may be separated for inspection and repair while remaining secured to the base member.

Cable guides are coupled to the base member to prevent the cables from kinking. The cable guard preferably has a channel formed between two curved surfaces.

The base member is preferably painted a bright and/or flourescent color to increase visibility and prevent inadvertent damage. Reflective material may be disposed on the base member as well. In addition, a flag can be attached to the base member.

These and other objects, features, advantages and alternative aspects of the present a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 2:
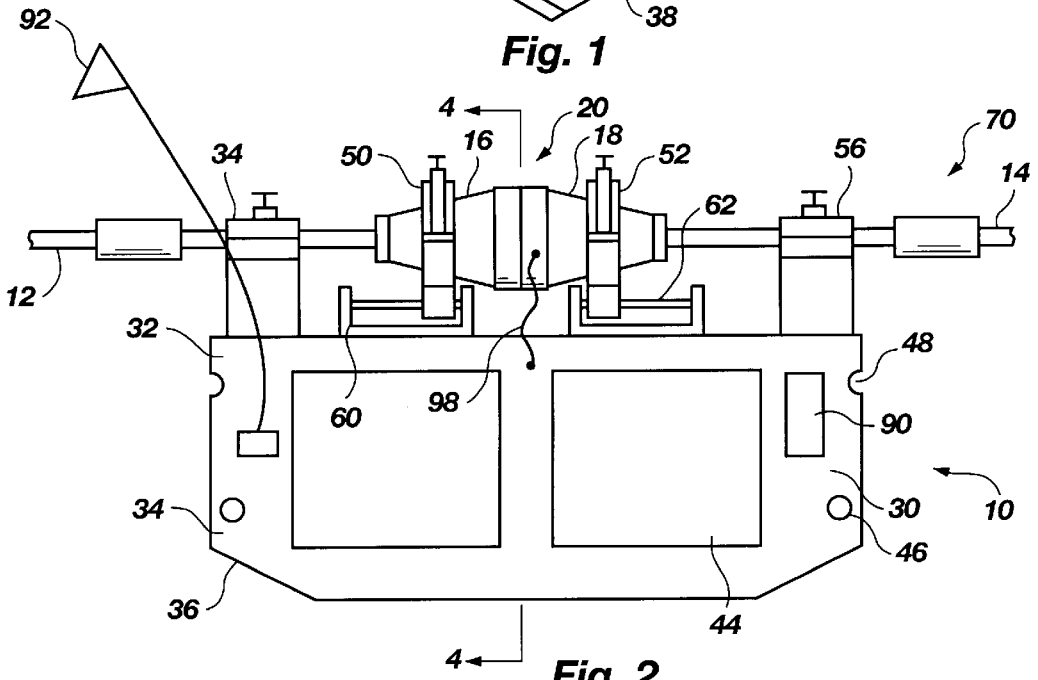
FIG. 2 is a side elevational view of a preferred embodiment of the electric cable connector device of the present invention.

As illustrated in FIG. 2, an electric cable connector device 10 of the present invention is shown with a first cable 12 and a second cable 14. Attached to the ends of the first and second cables 12 and 14 are first and second pothead connectors 16 and 18 respectively. The pothead connectors 16 and 18 connect together and form an electrical connection 20 between the two cables 12 and 14. As the cables 12 and 14 are moved or pulled, a force is exerted on the connection 20 tending to separate the potheads 16 and 18. In addition, the connection 20 lies on or is drug along the ground, exposing the connection to dirt and moisture contamination as well as creating the potential for electrical shorts and electrocution. Furthermore, the position of the connection 20 on the ground decreases its visibility, thus increasing the likelihood that other heavy equipment will drive over and damage the connection 20.

As illustrated in FIGS. 1–4, the connector device 10 has a base member 30. The base member 30 advantageously has an elevated portion 32 above the ground. The potheads 16 and 18 or cables 12 and 14 are secured, as described later, to the elevated portion 32 of the connector device 10 such that the connection 20 is maintained above the ground. Therefore, the connection 20 is kept off the ground to prevent electrical shorts and away from dirt and moisture contamination. In addition, the connection 20 is more visible off the ground and less likely to be damaged by heavy equipment.

The base member 30 preferably has a wide lower portion 34 in contact with the ground. Because of the weight of the cables 12 and 14 and potheads 16 and 18, the center of gravity of the connector device 10 is relatively high. Therefore, the width of lower portion 34 prevents the connector device 10 from falling or being overturned as the cables 12 and 14 are moved or pulled on.

The connector device 10 also advantageously has a skid or sled 36 formed on the lower portion 32 of the base member 30. The sled 36 contacts the ground and permits the connector device 10 to move or slid along the ground. As the cables 12 and 14 are moved or pulled on, as when equipment moves about, the connector device 10 moves along with the cables. Therefore, any force exerted on the connection 20 or connector device 30 acts to move or slide the device 10, rather than to damage the cables 12 and 14, connection 20, or device 10.

As shown in FIGS. 1–4, the sled 36 may be similar to a pair of spaced apart, parallel skis. It is of course understood that the skid or sled 36 may be of any appropriate configuration including a flat, plate-like member spanning the entire area under the base member. Alternatively, a plurality of wheels may be used to permit the connector device 10 to move on the ground. The wheels may be coupled to the base member. All the wheels may be coupled in rigid alignment, such that the device 10 has a tendency to move in a substantially linear direction of travel. Some or all of the wheel may be pivotally attached such that the device 10 may travel in any direction.

Figure 1:
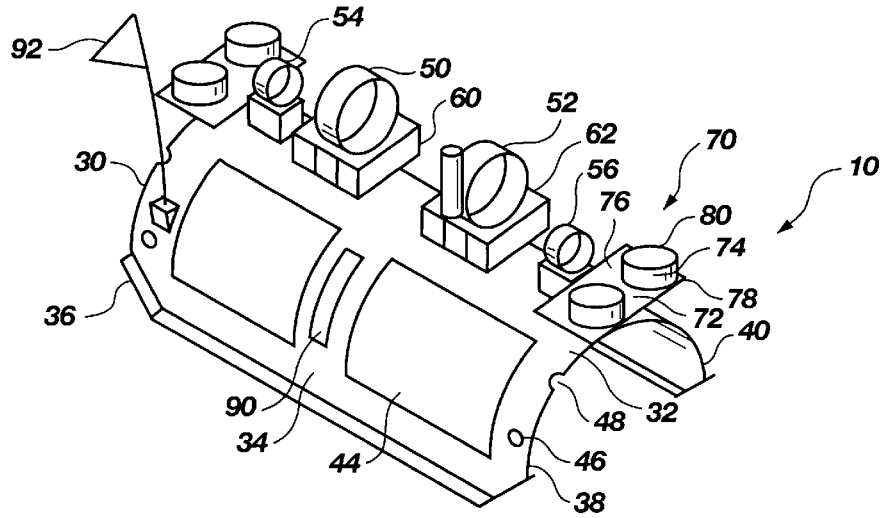
FIG. 1 is a perspective view of a preferred embodiment of an electric cable connector device of the present invention.
Figure 3:
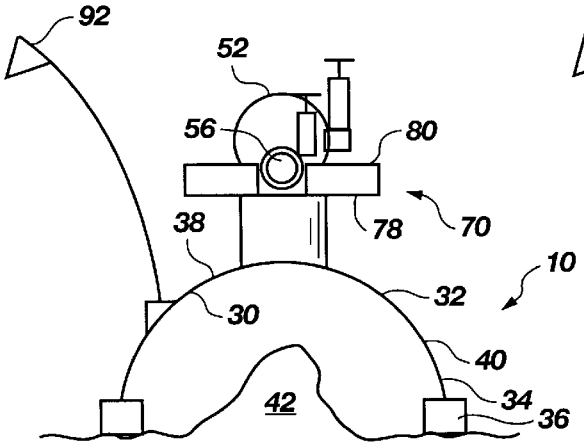
FIG. 3 is an end elevational view of preferred embodiment of the electric cable connector device of the present invention.
Figure 4:
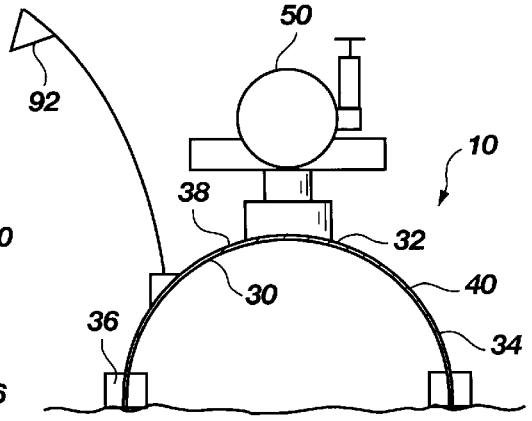
FIG. 4 is a cross section view of a preferred embodiment of the electric cable connector device of the present invention taken along line 4—4 of FIG. 2.

The electric cables 12 and 14 are typically located along the side of a road having a berm. Referring to FIGS. 1, 3 and 4, the connector device 10 also advantageously has a first leg portion 38 and second leg portion 40 configured for straddling a berm, indicated at 42 in FIG. 3. If the connector device 10 is positioned so that the leg portions 38 and 40 straddle a berm along the side of a road, the leg portions 38 and 40 maintain the position of the connector device 10 at the side of the road. Thus, when moved, the connector device 10 tends to travel along the length of the berm. Therefore, the connection 20 and potheads 16 and 18 are prevented from being pulled into the road and damaged by heavy equipment. In addition, the connector device 10 may slid along the side of the road when pulled by equipment. In this manner, the berm acts as a track for the connector device 10 to travel along.

As shown in FIGS. 1–4, the base member 30 is shown as advantageously having an elongated body of roughly semi-circular or arcuate cross section with open ends. This configuration is particularly well suited for use with a berm. The halves of the semi-circle or arc provide the first and second leg members for straddling a berm and the open ends permit the base member to straddle the berm. In addition, the sled portion may be formed as elongated skis on the ends of the semi-circular base. It is of course understood that the base member may be of any appropriate configuration, including square or triangular cross sections, closed ends, solid bottoms, etc.

As illustrated in FIGS. 1 and 2, fork lift apertures 44 are advantageously formed in the base member 30. The apertures 44 are sized such that the forks of a forklift may move and position the connector device 10. In addition, the apertures permit the connector device 10 to be moved alone or while in use with electrical cables 12 and 14 attached. Chain apertures 46 and notches 48 are also formed in the base member 30. The apertures 46 are sized such that chains or cables may be attached to the base member 30 for dragging the device 10.

A first connector clamp 50 and a second connector clamp 52 are advantageously disposed on the elevated portion 32 of the base member 30 for securing the first and second pothead connectors 16 and 18 to the base member 30 respectively. The connector clamps 50 and 52 releasably clamp the potheads. Thus, the clamps may be opened to receive the potheads and then closed about the potheads to secure them.

Figure 5:
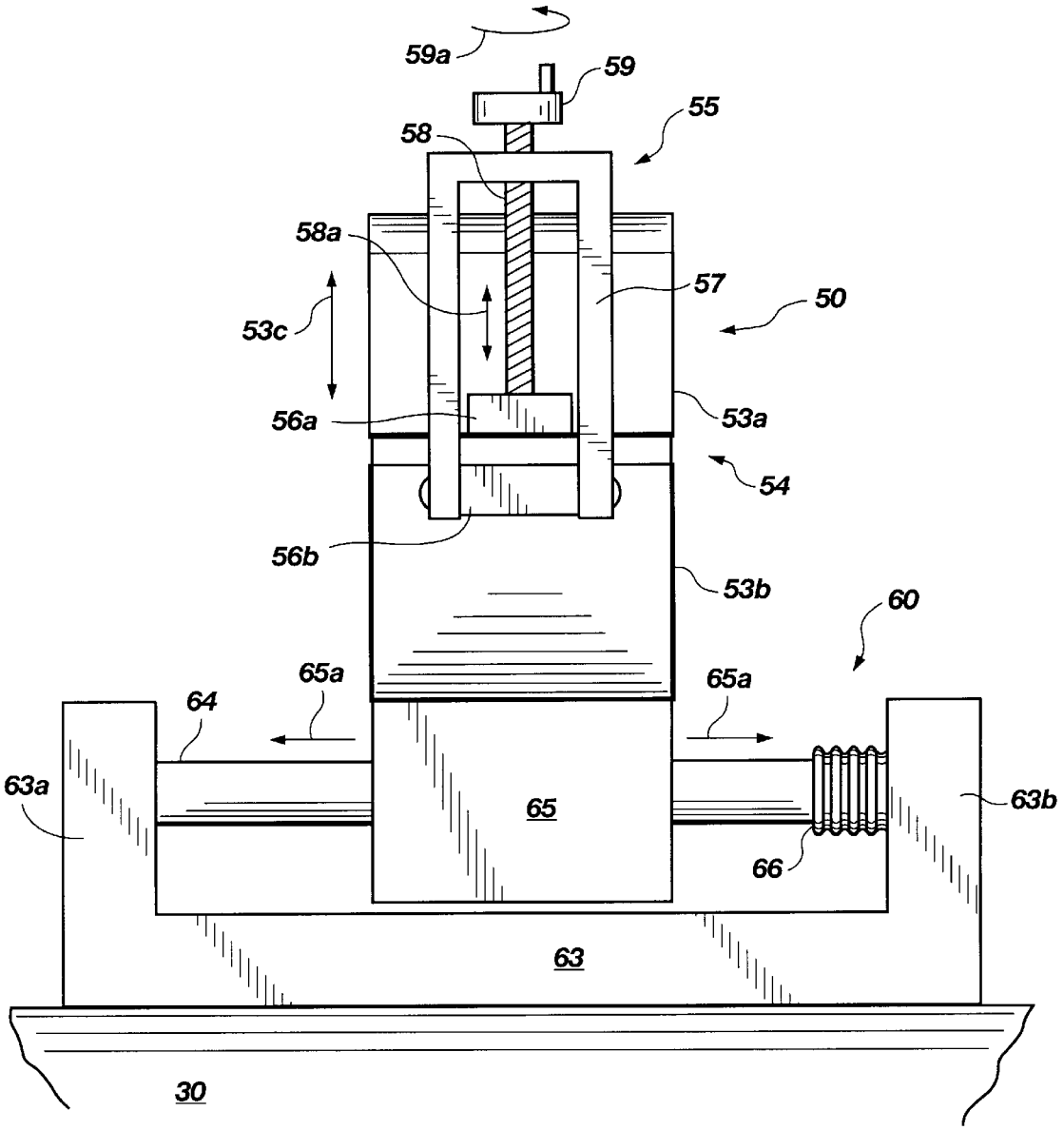
FIG. 5 is a front elevational view of preferred embodiment of the slide mechanisms and connector clamps of the electric cable connector device of the present invention.

As illustrated in FIG. 5, the connector clamps, represented by connector clamp 50, each have two half-circular portions including an upper portion 53*a* and a lower portion 53*b* hinged together at one end (not shown in FIG. 5) and open at the other end, as indicated at 54. The lower portion 53*b* is coupled to the base member 30 as will be discussed later. The upper portion 53*a* pivots about the hinge to open and close the clamp 50, indicated at 53*c*.

The connector clamp 50 has a variable securing device 55 for securing the upper and lower portions 53*a* and 53*b* at the opening 54 through a range of openness. Thus, potheads of various diameters or various portions of the potheads with different diameters may be securely clamped in the connector clamps 50 and 52. The securing device 55 includes a upper tab 56*a* formed on the upper portion 53*a* at the opening 54 and a lower tab 56*b* formed on the lower portion 53*b* at the opening such that the upper tab 53*a* is disposed generally above the lower tab 53*b*. A U-shaped member 57 has its open end pivotally attached to the lower tab 56*b* such that the closed end of the U-shaped member 57 may be pivoted above the upper tab 56*a* or away from the upper tab.

A threaded member 58 threadedly engages the closed end of the U-shaped member 57 and extends through the closed end and into the interior of the U-shaped member. A knob 59, or similar device, is disposed on the threaded member 58 on the outside of the U-shaped member 57. By rotating the knob 59, indicated at 59*a*, the threaded member may be advanced or withdrawn, indicated at 58*a*, into or out of the U-shaped member. The pothead may be secured in the connector clamp 50 by pivoting the U-shaped member 57 so that the closed portion is located above the upper tab 56*a* and advancing the threaded member 58 until it engages the upper tab 56*a*, forcing the upper tab 56*a* towards the lower tab 56*b*. The threaded member 58 is preferably stainless and engages the U-shaped member 57 through a brass nut. In addition, the U-shaped member 57 is preferably attached to the lower tab 56*b* by a stainless pivot pin. Thus, the connector clamps are resistant to inclement weather.

The securing device 58 allows the potheads to be quickly secured and released. The securing device 58 is variable so that potheads of various diameters may be effectively secured and the clamps may be sufficiently tightened about the pothead. By securing the connector potheads 16 and 18 to the base member, the connection 20 is maintained above the ground and prevented from falling off the base member 30. In addition, the base member 30 moves with the cables 12 and 14 as they are moved and pulled by the equipment.

Referring to FIG. 2, a first cable clamp 54 and a second cable clamp 56 are advantageously disposed on the elevated portion 32 of the base member 30 for securing the first and second cables 12 and 14 to the base member 30 respectively. The cable clamps 54 and 56 releasably clamp the cables and have a rubber lining to prevent damage to the cables. The cable clamps 54 and 56 are similar to the connector clamps 50 and 52, but are sized for the cables 12 and 14. By securing the cables 12 and 14 to the base member, the connection 20 is maintained above the ground and prevented from falling off the base member 30. In addition, the base member 30 moves with the cables 12 and 14 as they are moved and pulled by the equipment.

The clamps 50, 52, 54 and 56 also hold the cables 12 and 14 and potheads 16 and 18 together. Therefore, as the cables move or are pulled, the force tending to separate the potheads is transferred to the base member rather than the connection. It is of course understood that any appropriate type of attachment may be used to secure the cables and potheads to the base member, including directly bolting them together.

Although the clamps have been particularly described and illustrated, it is of course understood that the clamps may be of any appropriate type suitable for securing the potheads to the base member-4, the clamps are shown disposed on an upper side of the elevated portion of the base member. It is of course understood that the connection may be disposed on the under side of the elevated portion. Such a configuration would provide additional protection from rain or falling debris.

Referring to FIG. 2, the first and second connector clamps 50 and 52 are preferably disposed on first and second slide mechanisms 60 and 62 respectively. Referring again to FIG. 5, the connector clamps, represented by connector clamp 50, are disposed on the slide mechanisms, represented by slide mechanism 60. The slide mechanism 60 has a slide base 63 disposed on the base member 30. The slide base 63 is a U-shaped member with a pair of upwardly extending arms 63*a* and 63*b* disposed on either side of the slide base. A pair of rods 64 (only one of which is shown in FIG. 5) extend between the arms 63*a* and 63*b* of the slide base 63. A slide 65 is slidably disposed on the rods 64. The rods 64 pass through bores formed in the slide 65. The rods 64 form a track upon which the slide 65 may slide back and forth, indicated by arrows 65*a*. A rod protector 66 may be disposed about the exposed portion of the rods 64 to protect the rods from dirt and moisture. The rod protector 66 is flexible so that it expends and contracts as the slide 65 moves back and forth along the rods. In addition, spring members (not shown) may be disposed on the rods 64 to bias the slide 65 in a particular direction.

The rods 64 are preferably stainless and the bores are preferably fitted with brass bushings. Thus, the slides are resistant to inclement weather.

Although the slide mechanisms are shown as slides riding on rods held by a slide base, it is of course understood that the slide mechanisms may be of any appropriate type, including track-and-carriage, tongue-and-groove, etc.

As shown in FIGS. 1–2, the slide mechanisms 60 and 62 are disposed between the connector clamps 50 and 52 and the elevated portion 32 of the base member 30 so that the potheads .16 and 18 can be disconnected and slid apart. Because the potheads 16 and 18 are each secured to the base member 30 by the connector clamps 50 and 52, they remain secured to the base member even when the connection 20 is broken and the potheads are slid apart. In this way the connection 20 and the potheads 16 and 18 may be inspected and maintained without the potheads contacting the ground and becoming contaminated.

As shown in FIG. 2, both connector clamps are shown disposed on sliding mechanisms. It is of course understood that only one connector clamp may be disposed on a slide mechanism or that the cable clamps may be disposed on slide mechanisms as well.

Referring to FIG. 1, the connector device 10 advantageously has cable guides 70 coupled to the base member 30. The cable guides 70 prevent the cables 12 and 14 (as shown in FIG. 2) from kinking as the cables are moved about the connector device 10. The cable guides 70 preferably have a channel 72 formed by outwardly curving surfaces 74. The cables 12 and 14 rest in the channel 72 and bend around the curved surfaces 74 as they are moved. Thus, the cables 12 and 14 are prevented from kinking. The cable guides 70 preferably have a substantially horizontal base plate 76 on which the cables 12 and 14 rest. A down turned lip 78 is formed on the outer facing edge of the plate 76 to prevent the cables from snagging on the plate 76. The channel 72 is formed by a pair of spaced apart, vertical cylinders 80 disposed on the plate 76.

Referring to FIGS. 1 and 2, to increase the visibility of the connection 20 and the connector device 10, the base member 30, as well as other components, may be painted a bright or flourescent color. In addition, a reflective material 90, such as reflective stickers, may be applied to the connector device 10. Furthermore, a flag 92 maroad barricades, may be disposed on the base member. The color, reflective material, flag, and/or lights increase the visibility of the connector device 10, preventing inadvertent damage to the connection 20 by other heavy equipment.

As shown in FIG. 2, a ground wire 98 may be connected between the potheads 16 and 18 and the base member 30.

A hood member (not shown) may be coupled to the base member 30 and extend over the connection 20 to provide protection from the elements. The hood member may be an umbrella-like structure to protect the connection from rain or may be a substantial structural member to protect the connection from falling debris and well as rain.

A single connection between the ends of two cables has been shown in the figures and discussed above. The present invention may be used for multiple connections between multiple cables by including a sufficient number of clamps. In addition, although the above description has focused on cables supplying high-voltage electrical power, the cables may also be communications cables carrying electrical signals or fiber optics. Furthermore, the present invention may be used with supply lines carrying water, fuel, and other liquids or gases.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. An electric cable connector device for maintaining at least one connection formed by an end of each of two or more electrical cables, the device comprising:

a base member movable on the ground and having an elevated portion above the ground for maintaining the at least one connection above the ground and a first leg portion and a second leg portion such that the base member is configured for straddling a berm with the first leg portion on one side of the berm and the second leg portion on another side of the berm; and securing means disposed on the base member for securing the end of each of the two or more cables to the base member such that the at least one connection is maintained above the ground while permitting at least one connection and base member to move, thereby preventing electrical shorts and dirt and moisture contamination.

2. The connector device of claim 1, further comprising:

moving means disposed between the base member and the ground for permitting the base member to move on the ground.

3. The connector device of claim 2, wherein the moving means comprises a sled portion formed on the base member between the base member and the ground such that the base member slides on the ground.

4. The connector device of claim 1, wherein the securing means comprises two or more connector clamps disposed on the elevated portion of the base member, the connector clamps releasably clamping each connector of the two or more cables.

5. The connector device of claim 1, wherein the securing means comprises two or more cable clamps disposed on the elevated portion of the base member, the cable clamps releasably clamping the two or more cables.

6. The connector device of claim 1, wherein the securing means comprises two or more connector clamps and two or more cable clamps disposed on the elevated portion of the base member, the connector clamps releasably clamping each connector of the two or more cables, the cable clamps releasably clamping the two or more cables.

7. The connector device of claim 1, further comprising:

sliding means disposed on the base member and the securing means disposed on the sliding means for sliding the ends of the two or more cables apart while the ends remain secured to the base member by the securing means.

8. The connector device of claim 1, further comprising:

a ground wire extending between the at least one connection and the base member.

9. The connector device of claim 1, further comprising:

apertures formed in the base member and configured for receiving forks of a forklift such that the connector device may be moved and positioned by a forklift.

10. The connector device of claim 1, further comprising:

apertures formed in the base member and configured for receiving a chain or cable such that the connector device may be moved and positioned by the chain or cable.

11. The connector device of claim 1, further comprising:

cable guide means coupled to the base member for preventing the two or more cables from kinking.

12. The connector device of claim 11, wherein the cable guide means comprises a channel formed between at least two curved surfaces.

13. The connector device of claim 1, wherein the base member is a highly visible color to increase visibility of and prevent inadvertent damage to the connector device and the at least one connection.

14. The connector device of claim 1, further comprising:

a flag coupled to the base member and extending upwardly to increase visibility of and prevent inadvertent damage to the connector device and the at least one connection.

15. The connector device of claim 1, further comprising:

a reflective material disposed on the base member to increase visibility of and prevent inadvertent damage to the connector device and the at least one connection.

16. An electric cable connector device for maintaining at least one connection formed by an end of each of two or more electrical cables, the device comprising:

a base member movable on the ground and having an elevated portion above the ground for maintaining the at least one connection above the ground, a first leg portion and a second leg portion such that the base member is configured for straddling a berm with the first leg portion on one side of the berm and the second leg portion on another side of the berm, and a sled portion formed on the base member between the base member and the ground such that the base member slides on the ground; and securing means disposed on the base member for securing the end of each of the two or more cables to the base member such that the at least one connection is maintained above the ground while permitting the at least one connection and base member to move, thereby preventing electrical shorts and dirt and moisture contamination.

17. The connector device of claim 16, wherein the securing means comprises two or more connector clamps disposed on the elevated portion of the base member, the connector clamps releasably clamping each connector of the two or more cables.

18. A method for maintaining at least one connection formed by an end of each of two or more electrical cables, said method comprising the steps of:

(a) providing a base member movable on the ground and having an elevated portion above the ground and a first leg portion and a second leg portion such that the base member is configured for straddling a berm with the first leg portion on one side of the berm and the second leg portion on another side of the berm; and (b) securing the end of each of the two or more cables to the base member such that the at least one connection is maintained above the ground while permitting the at least one connection and base member to move thereby preventing electrical shorts and dirt and moisture contamination.

* * * * *